United States Patent [19]

Brown et al.

[11] Patent Number: 4,813,594

[45] Date of Patent: Mar. 21, 1989

[54] MICROWAVABLE PACKAGE

[75] Inventors: William M. Brown, Darien, Conn.; Frances DeCarlo, Middletown, N.Y.

[73] Assignee: Federal Paper Board Co., Inc., Montvale, N.J.

[21] Appl. No.: 137,563

[22] Filed: Dec. 24, 1987

[51] Int. Cl.[4] ..... B65D 5/54; B65D 85/36

[52] U.S. Cl. ..... 229/103; 206/45.19; 229/104; 229/119; 229/903; 229/906; 426/113; 426/114; 426/122

[58] Field of Search ..... 219/10.55 E; 426/107, 426/113, 114, 122, 123; 206/44 R, 425, 45.13, 45.14, 45.19, 612, 620, 624; 229/103, 104, 119, 154, 902, 903, 905, 906, 120.18

[56] References Cited

U.S. PATENT DOCUMENTS

| | | | |
|---|---|---|---|
| 1,678,671 | 7/1928 | Duffield | 206/425 |
| 2,375,843 | 5/1945 | Gottlieb | 206/45.19 |
| 2,435,135 | 1/1948 | Franck | 206/44 R |
| 2,727,619 | 12/1955 | Paige | 206/44 R |
| 2,827,162 | 3/1958 | Garman | 206/44 R |
| 2,993,633 | 7/1961 | Keller | 229/903 |
| 3,078,028 | 2/1963 | Skowronski | 219/104 |
| 3,177,610 | 4/1965 | Smith | 229/120.18 |
| 3,324,999 | 6/1967 | Farquhar | 229/103 |
| 4,449,633 | 5/1984 | Johnson et al. | 206/612 |
| 4,584,202 | 4/1986 | Roccaforte | 426/113 |

*Primary Examiner*—Stephen Marcus
*Assistant Examiner*—Gary E. Elkins
*Attorney, Agent, or Firm*—Charles E. Brown; Charles A. Brown

[57] ABSTRACT

This relates to a carton for packaging a product which is to be processed in a microwave. The carton includes a top wall which is hinged to a portion of a rear wall and has a glue flap bonded to a removable portion of a front wall. The carton is formed of a delaminatable web with the top wall having transversely spaced score lines in opposite faces thereof whereby the carton is openable by removing the removable portion of the front wall and then peeling a major portion of the top wall from border portions thereof to open the carton. After the product has been removed, the top wall is swingable into the interior of the carton to form a support platform for the product. The support platform is positioned a predetermined distance above the bottom wall of the carton to provide for a maximum efficiency of the heating of the product within a microwave oven.

20 Claims, 2 Drawing Sheets

72
70
20
72

138
54
140
134
132

66
74
54
126
128
124
42
22
32

74
66
128
124
54
54
22
42
32

126
124
128
54
22
42
32
74
66

126
7
54
122
136
128
120
62
34
134
22
7

288
206
54
294
216
208
218
290
296
228
98
42
220

MICROWAVABLE PACKAGE

This invention relates in general to new and useful improvements in carton type packages, and more particularly to a package which is particularly adapted for use in conjunction with a microwave.

It has been found that if a product to be heated in a microwave is positioned a certain distance above the floor of the microwave, for example $\frac{5}{8}$ to $\frac{3}{4}$ of an inch, a better heating effect is obtained. On the other hand, if a carton is constructed so as to have a false bottom to obtain the spacing of the product above the floor of the microwave, this involves more paper and thus an expensive carton.

In view of the foregoing, this invention relates to a carton which is so constructed wherein when it is opened in the normal manner, the original top wall may be folded into the interior of the carton to a position spaced above the bottom of the carton and thus provide a support for the product being heated within a microwave.

A most important feature of the invention is the fact that the carton is formed of a readily delaminatable material whereby by offsetting cuts in panels of the carton in opposite faces of such panels, one may easily open the carton and still have full width panels.

Another feature of the invention is the utilization of the carton in a method wherein the carton is opened, the product packaged therein is removed, the top panel of the carton is moved into the carton to form a supporting shelf and the product is placed back onto that shelf.

With the above and other objects in view that will hereinafter appear, the nature of the invention will be more clearly understood by reference to the following detailed description, the appended claims, and the several views illustrated in the accompanying drawings.

Figure 1:
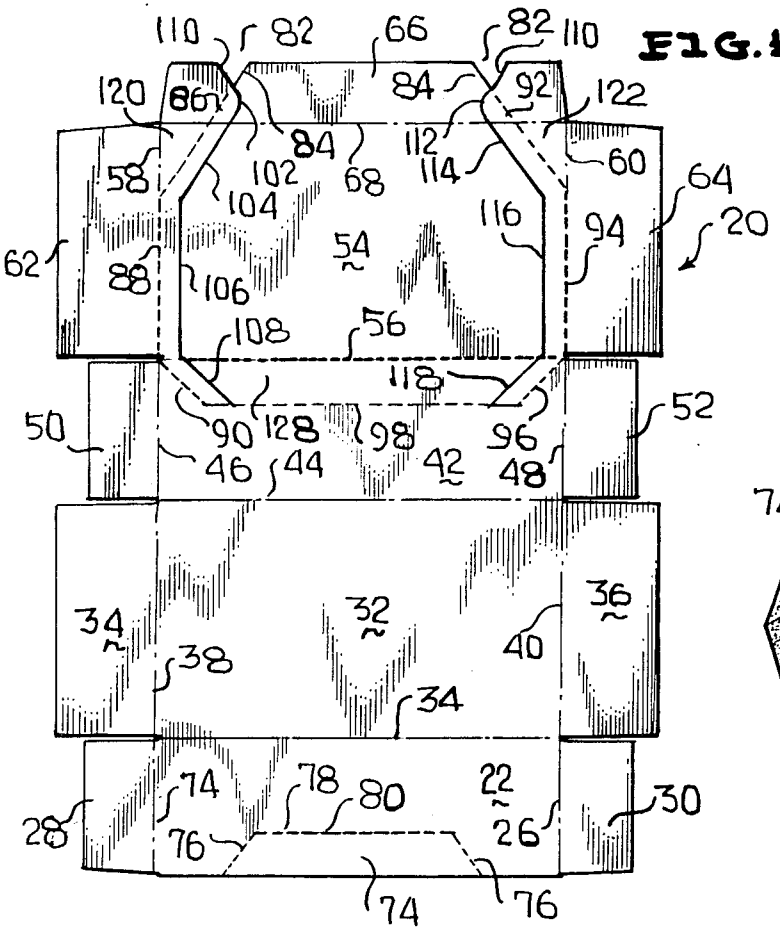
FIG. 1 is a plan view of a blank from which the carton of this invention is formed.

Referring now to the drawings in detail, reference is first made to FIG. 1 wherein there is illustrated the details of a typical blank for forming a carton in accordance with this invention, the blank being generally identified by the numeral 20. The blank 20 is provided at one end thereof with a front panel 22 which has hingedly connected to opposite ends thereof along fold lines 24, 26, end panels 28, 30. A bottom panel 32 is hingedly connected to the front panel 22 along a transverse fold line 34. The bottom panel carries two end panels 34, 36 which are connected to opposite ends thereof along longitudinal fold lines 38, 40. A rear panel 42 is hingedly connected to the opposite side of the bottom panel 32 along a transverse fold line 44. The rear panel 42 carries at opposite ends thereof along fold lines 46, 48, end panels 50, 52.

Adjacent the opposite end of the blank 20 is a top panel 54 which is hingedly connected to the opposite edge of the rear panel 42 along a transverse fold line 56. The top panel 54 has hingedly connected to opposite ends thereof along longitudinal fold lines 58, 60, end flaps 62, 64. Finally, at the end of the blank 20 remote from the front panel 22 is a glue flap 66 which is connected to the top panel 54 along a transverse fold line 68.

Figures 4, 5, 6, 7, 8, 9, 10:
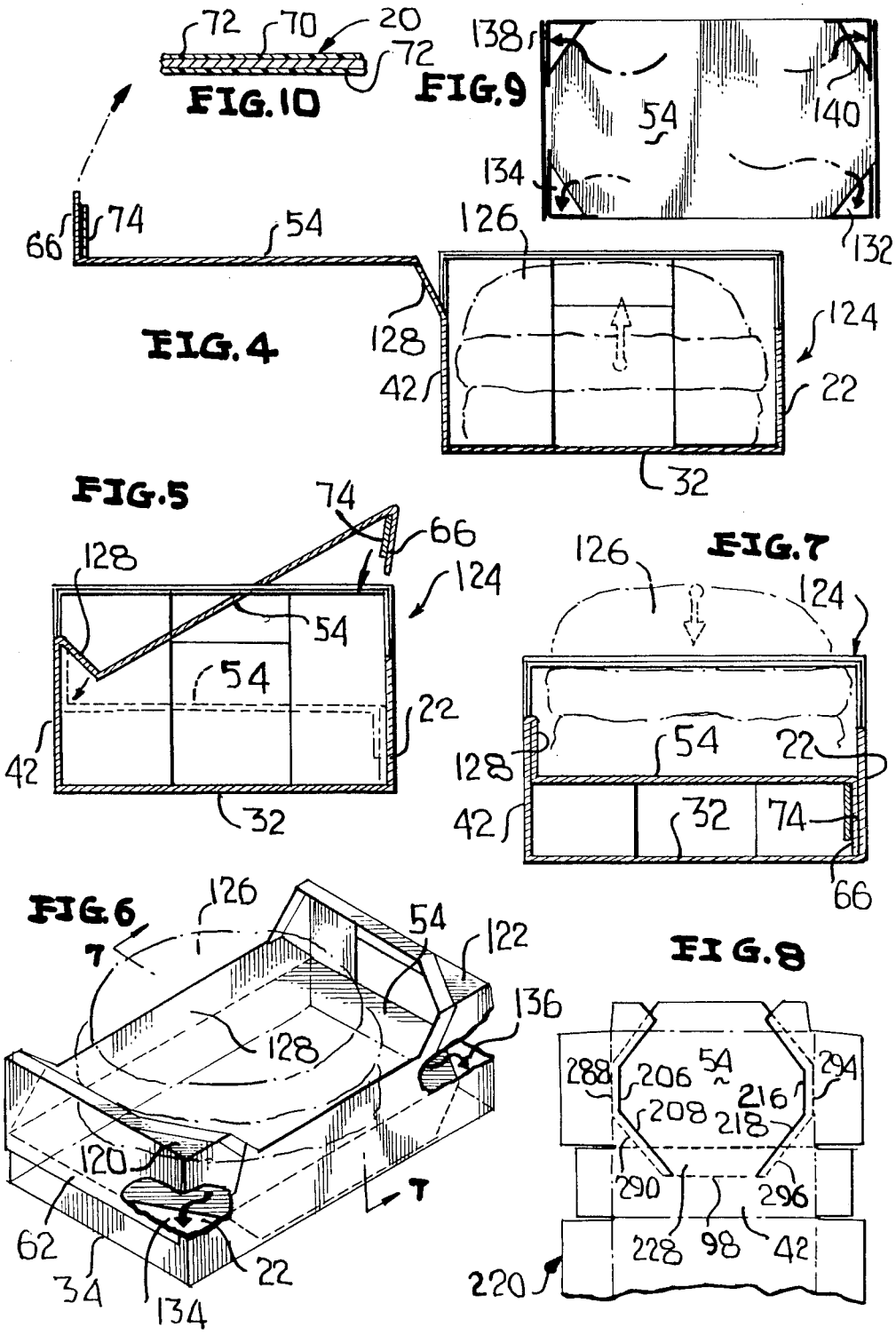
FIG. 4 is a transverse vertical sectional view taken generally along the line 4—4 of FIG. 3 and shows specifically the details of the open carton.
FIG. 5 is a transverse vertical sectional view similar to FIG. 4 showing the carton in the process of having the top wall thereof folded into the interior of the carton with the final position of the top wall being shown in dotted lines.
FIG. 6 is a perspective view of the folded carton ready to receive the product in supporting relation.
FIG. 7 is a transverse vertical sectional view taken generally along the lines 7—7 of FIG. 6 and shows the specific cross section of the carton and the manner in which the top wall becomes a support wall.
FIG. 8 is a fragmentary plan view on reduced scale of a slightly modified form of blank.
FIG. 9 is a top plan view of the modified carton formed from the blank of FIG. 8 with the carton in its open position ready to receive in supporting relation a product.
FIG. 10 is an enlarged fragmentary sectional view taken through a typical panel of the carton and shows the construction of such panel.

At this time, attention is directed to FIG. 10 wherein a typical cross section of the material of the blank 20 is illustrated. It will be seen that the blank 20 is formed from a web which includes a delaminatable paper core 70 having facing layers 72 which, if desired, may be formed of a plastic material. Thus if one should cut each of the facing layers 72 in spaced relation, the web which forms the blank 20 may be separated into two parts through the delamination of the core 70. This principle is utilized in the opening construction of the carton formed from the blank 20.

Referring once again to FIG. 1, it will be seen that the front panel 22 has formed along the free edge thereof a centrally located removable panel portion 74 which is defined at its side by sloping perforated lines 76 and between the lines 76 and remote from the free edge of the panel 22 by a cut line 78 which leaves uncut small portions 80 thereby permitting the panel portion 74 to be removed from the front panel 22.

The glue flap 66 is provided with a pair of widely spaced notches 82 in the free edge thereof remote from the fold line 68. Each of the notches 82 has an inner edge 84 which becomes aligned with the perforated lines 76 when the glue flap 66 is bonded to the front panel 22.

At this time it is pointed out that the blank 20, as illustrated in FIG. 1, illustrates what will be the inside surface of the resultant carton.

It will be seen from FIG. 1 that the surface of the glue flap 66 which will be the outermost surface in the resultant carton is provided with a score line 86 which is a continuation of the cut line 84. The score line 86 continues into the upper surface of the top panel 54 until it reaches the fold line 58. The score line 86 terminates in a similar score line 88 which extends in alignment with the fold line 58 to the fold line 56. The score line 88 terminates in a diagonal score line 90 formed in the outer face of the rear panel 42.

A score line 92, similar to the score line 86, is formed on the opposite side of the glue flap 66 and extends across the outer face of the top panel 54 to the fold line 60 where it joins a score line 94 which is aligned with the fold line 60. The score line 94 terminates at the hinge line 56 at a diagonally sloping score line 96 which is formed in the outer face of the rear panel 42. The ends of the score line 90 are joined together by a perforated combined weakening and hinge line 98.

As viewed in FIG. 1, the left-hand notch 82 has a left-hand edge 100. The glue flap 66 has formed in the illustrated or underside face thereof an angular score line 102 of which a part forms a continuation of the edge 100. The arcuate score line 102 terminates in a diagonal score line 104 in the underface of the top panel 54, the score line 104 being disposed parallel to the score line 86. The score line 104 terminates in a score line 106 which extends across the inner face of the top panel 54 parallel to the score line 88. The score line 106 terminates at the fold line 56 in a diagonal score line 108 in the inner face of the rear panel 42. The score line 108 is disposed parallel to the score line 90 and terminates in the perforated hinge line 98.

The right-hand notch 82 in the glue flap 66 has a right-hand edge 110. An arcuate score line 112 is formed in the inner face of the glue flap 66 as a continuation of the edge 110 and extends to the hinge line 68 where it is joined by a sloping score line 114 formed in the inner face of the top panel 54. The score line 114 extends parallel to the score line 92 and terminates in another score 116 in the inner face of the top panel 54 with the score line 116 being parallel to the score line 94 and extending to the hinge line 56. A diagonal score line 118 is formed in the inner face of the rear panel 42 and extends from the score line 116 to the perforated hinge line 98 in parallel relation to the score line 96.

It will be seen that the score line 86, 104 arrangement leaves a triangular corner 120 at the left front side of the top panel 54. A similar triangular corner 122 is defined by the score lines 92, 114.

Figure 2:
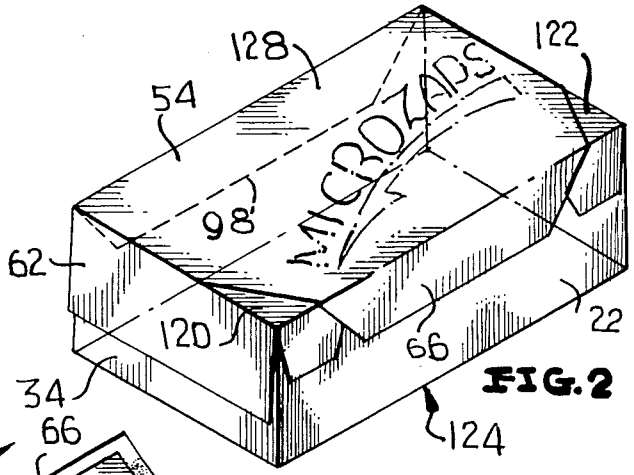
FIG. 2 is a perspective view of the closed carton.
Figure 3:
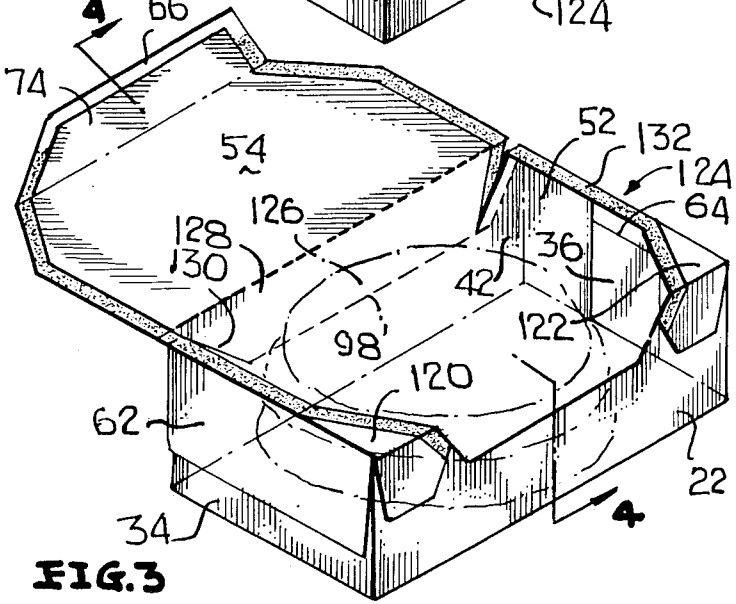
FIG. 3 is a perspective view showing the closed carton in its open state with a typical product shown within the carton in phantom lines.

As is best shown in FIGS. 2 and 3, a carton, generally identified by the numeral 124, is formed from the blank 20. The front panel 22 and the rear panel 42 are folded upwardly relative to the bottom panel 32 and the flaps 28, 30 and the flaps 50, 52 are folded inwardly, after which the flaps 34, 36, which function as glue flaps, are folded upwardly and are bonded to the flaps 28 and 50 on the one hand and the flaps 30 and 52 on the other hand. The open carton is now ready to receive a product which is to be packaged, the product being shown in phantom lines in FIG. 3 and being identified by the numeral 126. The carton is now ready for closing.

The top panel 54 is brought to its carton closing position as shown in FIG. 2 and the glue flap 66 is bonded to the then upper portion of the front panel 22. It is to be noted that the central portion of the glue flap 66 is bonded to the removable panel portion 74 of the front panel 22. The glue flaps 62, 64 are then folded down along opposite sides of the carton and are bonded to the flaps 34, 36. The carton is now closed ready for shipment.

The carton 124, when it is opened, as shown in FIG. 3, is not opened in the conventional manner, but is primarily opened by a delimination of portions of the glue flap 66, the top panel 54 and an outlined upper rear portion 128 of the rear panel 42. In the opening operation, the panel portion 74 is torn from the front panel and remains attached to that portion of the glue flap 66 disposed between the notches 82. The portions of the glue flap 66, the top panel 54 and the panel portion 128 between the previously described score lines now delaminate to permit the top panel 54 to move to an open position, as is shown in FIG. 3 while leaving portions of the top panel 54, including the corners 120, 122 and outer end portions of the glue flap 66 attached to the main part of the carton. The panel portion 128 also hinges outwardly and rearwardly along the perforated fold line. It will be seen that the top panel 54 remains of the full width of the carton 124 due to the rupture of the carton along the score lines 88 and 94 while leaving generally half thickness edge portions 130, 132 attached to the glue flaps 62, 64.

The food product may be removed from the open carton 124, as is shown in FIG. 4, after which the top panel 54 will be folded into the interior of the carton 124 to form a supporting shelf as is best shown in FIG. 7.

By drawing the panel portion 128 inwardly to the position shown in FIG. 5 and reversely hinging the top panel 54 with respect to the handle portion 128, the part of the top panel 54 which has been released from the remainder of the carton 124 may be moved into the interior of the carton 124 with the panel portion 128 being folded 180 degrees into the interior of the carton 124 from its original position. In the final position of the top panel 54 wherein it functions as a support or platform, with reference to FIG. 7, the left edge of the top panel 54 is supported by panel portion 128 while the right edge of the top panel 54 is supported by the central portion of the glue flap 66 which rests on the bottom panel 32. The top panel 54 in its position as a platform or support for the packaged product, is spaced from the bottom wall 32 a distance on the order of $\frac{5}{8}$ to $\mu$ of an inch, which distance has been found to be a most desirable spacing for a food product within a microwave oven above the floor of the microwave oven.

The food product 126 will now be replaced in the carton 124 and seated on the top panel 54 as shown in FIG. 7 ready for processing in a microwave oven Returning now to FIG. 7, it will be seen that while the top panel 54 generally is of an outline to fill the cross section of the carton 124, due to the formation of the corners 120, 122 which remain in position at the top of the carton, corner voids 134, 136 are provided so that grease and other liquids from the product 126, which may occur during processing, will run into the bottom of the carton 124 as indicated by the arrows in FIG. 7.

After the product 126 has been processed in the microwave oven in the customary manner, it is removed by removing the carton 124 and then removing the product 126 from the carton. The carton is then disposed of in the customary manner.

In FIG. 8 there is illustrated a slightly modified form of carton blank, generally identified by the numeral 220. The carton blank 220 is identical to the carton blank 20 except for certain of the score lines. The score lines 88 and 106 have been foreshortened to form shorter score lines 288, 206, while the score lines 90, 108 have been moved inwardly and made longer so as to also extend across the outer surface of the top panel 54 and thus become score lines 290, 208. On the other side of the carton blank 220, the score lines 116, 94 have been shortened to form short score lines 216, 294, while the score lines 118, 96 have been moved inwardly on the rear panel 42 to form score lines 218, 296. This also results in the perforated hinge line 98 being foreshortened and resulting in a short panel portion 228. The net result is, as is schematically illustrated in FIG. 9, the top panel 54, when it functions as a platform, has in addition to the openings 134, 136 similar triangular openings 138, 140 at the rear corners of the carton.

It is to be understood that where the rear panel 42 and the top panel are delaminated to provide like portions on each part thereof, the like portions are sufficiently thin so as to permit the deflection of one another and the bypassing of the panel portion 128 with respect to the panel 42 as well as the moving and fixed portions of the top panel 54 bypassing one another.

Although it is preferred that the front flap 66 be releasably secured to the front wall 22 by way of the removable panel portion 74, it is to be understood that the carton is not so restricted. For example, the front flap 66, in addition to having the remote ends thereof permanently bonded to the front wall 22, may have a releasable bond with the front wall 22. The releasable bond could be in the form of separable bonds or could be by way of an extension of the front flap central portion which includes a conventional pull strip.

In addition, it is to be noted here that the carton may either be of the top loading type or the end loading type. When the carton 20 is of the top loading type, the product is placed within the carton before the top panel is moved to the carton closing position. On the other hand, if the carton is to be of the end loading type, the top panel 54 is moved to its carton top closing position, but one end of the carton is left open by permitting the flaps 64, 52, 36 and 30, for example, to project from the end of the carton with these flaps then being sequentially folded into place after the product is loaded through the open end of the carton defined by these flaps.

Although only several preferred embodiments of the carton have been specifically illustrated and described herein, it is to be understood that minor variations may be made in the carton construction without departing from the spirit and scope of the invention as defined by the appended claims.

We claim:

1. A combined package forming and heating carton comprising an open top carton body having a bottom and upstanding walls, said upstanding walls including front and rear walls and end walls, a closure hingedly connected to an upper edge of said rear wall, said closure having a front flap bondable to said front wall to close said carton, said front wall and said front flap having a detachable connection for releasing said front flap, and said rear wall having an upper panel portion connected to a lower portion of said rear wall along an intermediate fold line, said upper panel portion in an opened state of said carton forming spacer a means for spacing one edge of said closure within said carton body below said carton body open top, and said front flap forming support means for supporting an opposite edge of said closure above said bottom wherein in the opened state of said carton said closure forms a seat for a product spaced a preselected distance above said bottom.

2. A carton according to claim 1 wherein said intermediate fold line terminates in spaced relation to said end walls, and said rear wall has rupture means extending upwardly from opposite ends of said intermediate fold line to the top edge of said rear wall.

3. A carton according to claim 2 wherein said carton i s formed of a delaminatable core and opposite facing layers, and said rupture means include spaced adjacent cut lines through said facing layers into said core.

4. A carton according to claim 1 wherein said releasable connection between said front flap and said front wall includes said front wall having a detachable portion, said front wall detachable portion has ends spaced from said end walls, said flap extends longitudinally of said front wall past said detachable portion and being permanently bonded to said front wall, and said flap having rupturable means extending transversely of said flap at opposite ends of said front wall detachable portion for separating a central portion of said flap from said flap portions permanently bonded to said front wall.

5. A carton according to claim 4 wherein said carton is formed of a delaminatable core and opposite facing layers, and said rupture means include spaced adjacent cut lines through said facing layers into said core.

6. A carton according to claim 1 wherein the combined heights of said rear wall below said upper panel portion and said flap in its state released from said front wall are substantially equal to the height of said carton body.

7. A carton according to claim 1 wherein said closure also has side flaps permanently bonded to said end walls, and transverse rupture means in said closure adjacent said end walls, said transverse rupture means extending between said rear wall upper panel portion and said front flap.

8. A carton according to claim 7 wherein said carton is formed of a delaminatable core and opposite facing layers, and said rupture means include transversely spaced adjacent cut lines through said facing layers into said core.

9. A carton according to claim 2 wherein said releasable connection between said front flap and said front wall includes said front wall having a detachable portion, said front wall detachable portion has ends spaced from said end walls, said flap extends longitudinally of said front wall past said detachable portion and being permanently bonded to said front wall, and said flap having rupturable means extending transversely of said flap at opposite ends of said front wall detachable portion for separating a central portion of said flap from said flap portions permanently bonded to said front wall.

10. A carton according to claim 9 wherein said carton is formed of a delaminatable core and opposite facing layers, and said rupture means include spaced adjacent cut lines through said facing layers into said core.

11. A carton according to claim 4 wherein the combined heights of said rear wall below said upper panel portion and said flap in its state released from said front wall are substantially equal to the height of said carton body.

12. A carton according to claim 11 wherein said carton is formed of a delaminatable core and opposite facing layers, and said rupture means include spaced adjacent cut lines through said facing layers into said core.

13. A carton according to claim 9 wherein the combined heights of said rear wall below said upper panel portion and said flap in its state released from said front wall are substantially equal to the height of said carton body.

14. A carton according to claim 13 wherein said carton is formed of a delaminatable core and opposite facing layers, and said rupture means include spaced adjacent cut lines through said facing layers into said core.

15. A carton according to claim 7 wherein said transverse rupture means include converging end portions adjacent said front flap defining flow paths through said closure of said reopened carton at front corners of said closure.

16. A carton according to claim 8 wherein one of said cut lines of each transverse rupture means is at an adjacent one of said end walls whereby said closure in said carton opened state extends the full distance between said end walls.

17. A method of packaging and heating a product, said method comprising the steps of providing an open top carton body having a closure hingedly connected to a rear wall of said carton body and said closure having a front flap, using the closure closing said carton open top by releasably bonding said front flap to a front wall of said carton body, selectively placing a product within the carton before or after the closing of the carton open top, thereafter opening said carton by releasing said front flap from said front wall and rearwardly displacing said closure, removing said product from said carton, folding an upper portion of said rear wall into said open carton body and displacing said closure into said carton body with said closure assuming a recessed position within said carton body spaced and supported above a bottom of said carton body by said rear wall upper portion and said front flap, seating said product in said opened carton body on said closure in spaced relation from said carton bottom for heating said product.

18. A method according to claim 17 wherein said carton is formed of a web including a delaminatable core having facing panels, said closure has a central displaceable portion defined by rupture means including spaced cut lines through said facing layers, and said carton is opened by delaminating said core between cooperating cut lines.

19. A method according to claim 17 wherein the front flap is releasably secured to the front wall by providing the front wall with a removable upper portion, and bonding the front flap to the front wall removable upper portion.

20. A method according to claim 17 wherein the front flap is releasably secured to the front wall by providing the front wall with a removable upper portion, and bonding the front flap to the front wall removable upper portion, and the carton is opened by removing the front wall removable upper portion to release the front flap.

* * * * *